US005156560A

United States Patent [19]

Thomas

[11] Patent Number: 5,156,560

[45] Date of Patent: Oct. 20, 1992

[54] LAMP SOCKET

[75] Inventor: Ronald E. Thomas, Warren, Pa.

[73] Assignee: GTE Products Corporation, Stamford, Conn.

[21] Appl. No.: 767,181

[22] Filed: Sep. 30, 1991

[51] Int. Cl.[5] ..... H01R 17/00

[52] U.S. Cl. ..... 439/699; 439/877; 439/741

[58] Field of Search ..... 439/700-707, 439/611-119, 741, 751, 877-882, 699

[56] References Cited

U.S. PATENT DOCUMENTS 2,576,856 11/1951 Robertson ..... 439/703
3,633,149 1/1972 Maltais ..... 439/612
4,255,010 3/1981 Jullien ..... 439/700
4,938,708 7/1990 Vigneau et al. ..... 439/612
4,938,709 2/1990 Smith et al. ..... 439/612

FOREIGN PATENT DOCUMENTS 0880873 4/1943 France ..... 439/741

*Primary Examiner*—David L. Pirlot
*Attorney, Agent, or Firm*—William H. McNeill

[57] ABSTRACT

An improved lamp socket, and method of fabricating same, including a housing having a cavity into which a plurality of contacts are inserted. The contacts function to mechanically retain the base of a lamp in place and to electrically connect the socket wiring to the contacts of such lamp.

10 Claims, 4 Drawing Sheets

LAMP SOCKET

BACKGROUND OF THE INVENTION

1. Field of the Invention

The present invention relates to a lamp socket. The lamp socket is particularly useful in motor vehicle applications.

2. Description of the Prior Art

The need for a lamp socket which will retain a lamp in a satisfactory manner regardless of mechanical random vibration generated by conditions internal and external of a motor vehicle is well known. Heretofore, lamp sockets have been provided which include dual retention beams which are molded as part of the socket insulation. Although the lamp is retained by such beams, a significant amount of undersirable lateral lamp movement occurs. Such lateral movement is detrimental to contact interface and is a common area of failure. In such lamp sockets the socket wires are typically terminated by means of a mechanical crimp and then sealed in place by potting or by a separate gasket. The process of assembling such a lamp socket includes more steps and greater cost than is desirable.

It is highly desirable to provide a lamp socket which will retain a lamp in a satisfactory manner regardless of any vibrations to which such lamp is typically exposed.

It is further desirable to provide such a lamp socket which will substantially reduce, if not eliminate, lateral movement of the lamp relative to the socket to thereby improve contact interface.

It is also desirable to provide such a lamp socket which does not require that the socket wires be terminated by mechanical crimp and then sealed by potting or by a separate gasket.

It is further desirable to provide a simplified and less costly assembly process for fabricating such a lamp socket.

It is also desirable to provide such a lamp socket wherein metal beams are provided which serve to retain the lamp in place and electrically connect the socket wiring to the lamp contact leads.

SUMMARY OF THE INVENTION

This invention achieves these and other results by providing an improved lamp socket having a cavity into which a lamp base can be disposed for mechanical connection to the lamp socket and electrical connection to contacts disposed within the cavity. The cavity is formed by at least one wall and includes an open upper end and a closed lower end. A base surface is provided which forms the closed lower end. Such base surface includes a plurality of slits extending therethrough, and further includes an upper base surface and a lower base surface. At least two opposing recesses are disposed within the cavity wall. At least two contacts are provided each having a pair of integral legs. Each contact has a portion disposed in a respective recess and each leg extends through a respective slit. One leg of each pair of integral legs includes a portion which is substantially parallel to and in engagement with the lower base surface and another leg of each pair of integral legs extends from the lower base surface.

The method for fabricating such a lamp socket comprising the steps of (a) inserting at least two contacts, each having a pair of integral legs, into the lamp cavity while also inserting each leg of each pair of integral legs through a respective slit of the plurality of slits; (b) bending a portion of one leg of each pair of integral legs substantially parallel to and into engagement with the lower base surface; (c) feeding a wire into contact with the bent portion and adjacent to the one leg; and (d) crimping the one leg relative to the wire and the other leg thereby clamping the wire between the one leg and the other leg to effect an electrical connection between the contact and the wire.

BRIEF DESCRIPTION OF THE DRAWINGS

This invention may be clearly understood by reference to the attached drawings in which.

DESCRIPTION OF THE PREFERRED EMBODIMENT

Figure 1:
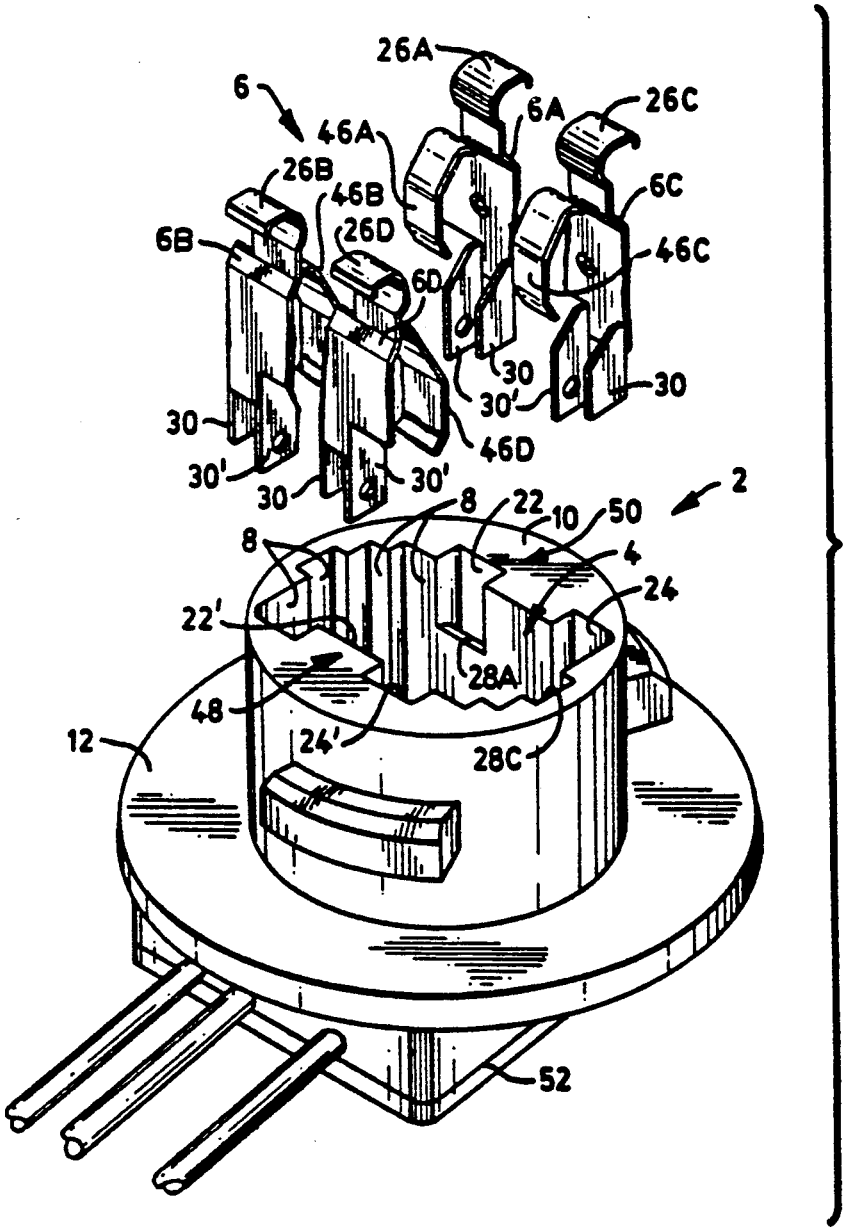
FIG. 1 is an exploded perspective view of one embodiment of the present invention.
Figure 2:
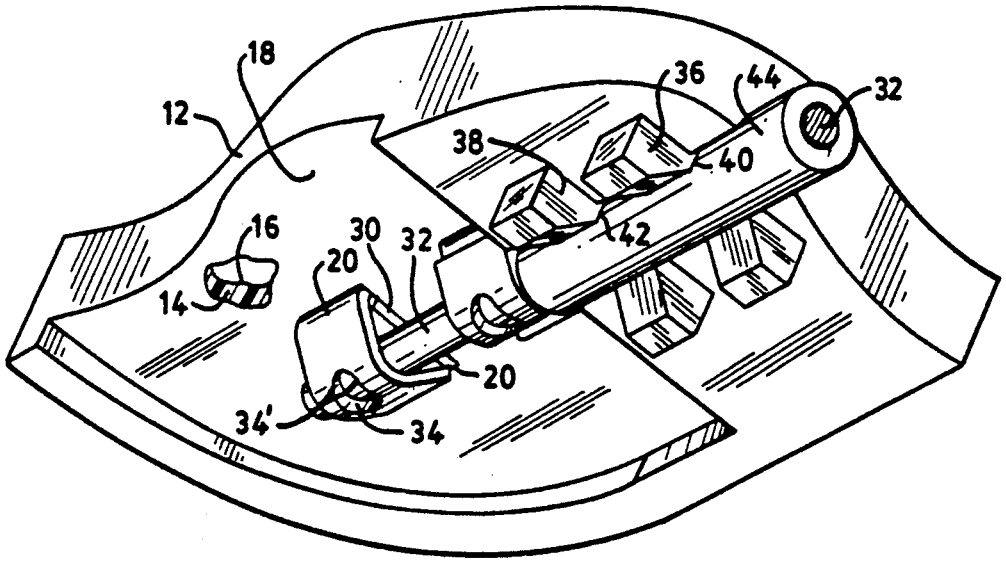
FIG. 2 is a perspective bottom view, partially in section, of a portion of the embodiment of FIG. 1.

The embodiment of this invention which is illustrated in the drawings is particularly suited for achieving the objects of this invention. FIGS. 1 and 2 depict a lamp socket including a housing 2 having a cavity 4 into which a lamp base can be disposed in a known manner, In the preferred embodiment, housing 2 is fabricated from nylon which is 43% glass filled. In the embodiment of FIGS. 1 and 2, a lamp base can be disposed in cavity 4 for improved mechanical connection to the lamp socket and electrical connection to contacts 6 which are disposed in the cavity as described herein. In the preferred embodiment, contacts 6 are fabricated from CDA 260 brass which has been underplated with 100 to 200 micro inches of nickel and then electroplated with 150 to 350 micro inches of an alloy of 60% tin and 40% lead. The cavity 4 is formed by at least one wall and includes an open upper end and a closed lower end. In the embodiment of FIGS. 1 and 2 the cavity 4 is formed by a plurality of walls 8 and includes an open upper end 10 and a closed lower end 12. A base surface 14 forms the closed lower end 12 and includes an upper base surface 16 and a lower base surface 18. A plurality of slits 20 extend entirely through base surface 14 from upper base surface 16 to lower base surface 18. There are at least two opposing recesses disposed within the wall(s) of the lamp socket cavity. In the embodiment of FIGS. 1 and 2 there are two pairs of opposing recesses 22, 22' and 24, 24' disposed within walls 8.

At least two opposing contacts are provided. Each contact includes a portion disposed within a respective recess. In the embodiment of FIGS. 1 and 2, four contacts are provided including opposing contacts 6A, 6B and opposing contacts 6C, 6D. Contacts 6A, 6B have a portion disposed in a recess 22, 22', respectively, and contacts 6C, 6D have a portion disposed in a recess 24, 24', respectively. In particular, contacts 6A, 6B, 6C and 6D each include a hooked portion 26A, 26B, 26C and 26D, respectively, which extends into a recessed base portion 28A, 28B (not shown), 28C and 28D (not shown), respectively, of a recess, 22, 22', 24, 24', respectively. Recessed base portions 28B and 28D are similar to recessed base portions 28A and 28C.

Each contact includes a pair of integral legs each of which extends through a respective slit 20. FIG. 2 depicts a pair of legs 30, 30' of contact 6C. It will be apparent to those skilled in the art that each of the other contacts 6A, 6B and 6D includes a similar pair of legs 30, 30' of disposed relative to the housing 2 in a manner similar to that of the legs of contact 6C. With reference to FIG. 2, two of the slits 20 are depicted having a pair of legs 30, 30' of contact 6C extending therethrough. One leg 30 of such pair of legs includes a portion which is substantially parallel to and in engagement with the lower base surface 18 as depicted in FIG. 2. In the preferred embodiment, such portion of the leg 30 will be formed by a 90° bend adjacent the lower base surface 18 to create a horizontal surface at such leg portion which will serve as a base for the other leg to retain an electrical wire to the contact as described herein. Another leg 30' of such pair of legs extends from the lower base surface 18. In the preferred embodiment, leg 30' will be longer than leg 30. In the embodiment of FIGS. 1 and 2 the leg 30' is crimped, relative to the leg 30 for clamping a wire 32 between leg 30 and leg 30' to effect an electrical connection between the contact 6C and the wire 32. Contact 6C will be held in place within cavity 4 as a result of the engagement of the hooked portion 26C extending into the recessed base portion 28C of recess 24 at one end of the contact 6C and the engagement of leg 30 with lower base portion 18 at the opposite end of leg 30. In this manner, the one piece housing 2 can serve as an insulator and effectively position and facilitate retention of the contacts 6A to 6D by means of individual precision recesses designed for each contact. In the preferred embodiment, leg 30' will include an aperture 34 extending therethrough. In this manner, a solder connection 34' can be provided which extends from the leg 30' through the aperture 34 and to the wire 32 and leg 30.

In the preferred embodiment, means is provided for guiding a wire relative to a respective pair of integral legs and preferably also for restraining a wire relative to a respective pair of integral legs. For example, in the embodiment depicted in FIG. 2, guide members 36, 38 are provided having channels 40, 42 respectively, which serve to guide wire 32 relative to legs 30, 30'. Guide members 36, 38 are preferably molded as part of the housing 2. In the preferred embodiment, the width of each channel 40, 42 will be less than the diameter of the insulation 44 of wire 32 so that wire 32 will be restrained relative to legs 30, 30', as a result of the insulation being pinched within such channels.

In the preferred embodiment, each contact will include an integral beam portion which will extend towards an opposing side of the cavity of the lamp socket. For example, contact 6A and 6C will include an integral beam portion 46A, 46C which will extend towards an opposing side 48 of cavity 4. In a like manner, contacts 6B and 6D will include an integral beam portion 46B, 46D which will extend towards an opposing side 50 of cavity 4. The base of a conventional wedge base lamp will be retained within cavity 4 by what will essentially be four independent stamped beams in the form of the opposing beams 46A and 46B and the opposing beams 46C and 46D. Beams 46A to 46D serve to provide the electrical contact. Beams 26A to 26D also mechanically retain the lamp wedge base within the cavity 4.

The wires 32 and legs 30, 30' at lower base surface 18 can be sealed and further retained by a cover which is affixed to the lower base surface. In the preferred embodiment a nylon cover 52 is molded to lower base surface 18 to form an integral bottom cover.

Figure 3A:
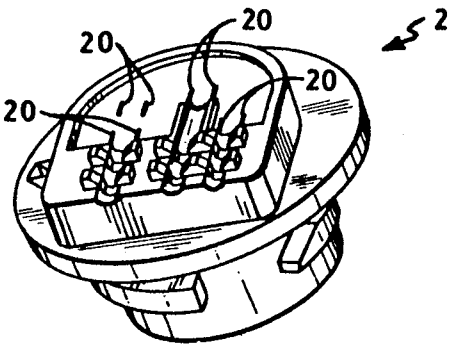
FIGS. 3A to 3G are perspective views of the embodiment of FIG. 1 sequentially depicting the fabrication thereof.
Figure 3B:
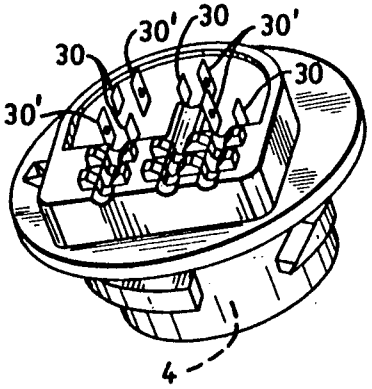
Figure 3C:
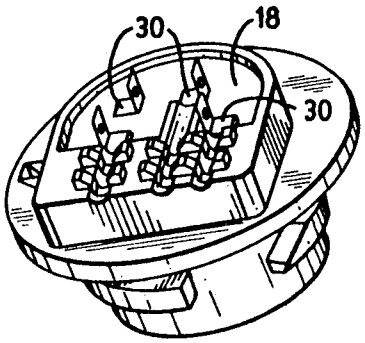
Figure 3D:
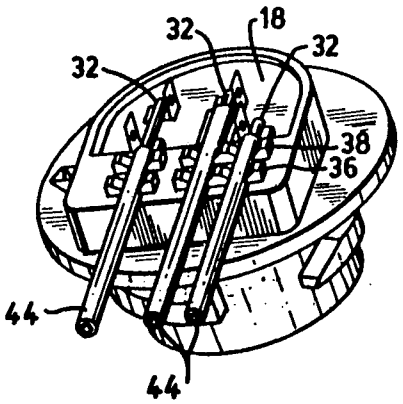
Figure 3E:
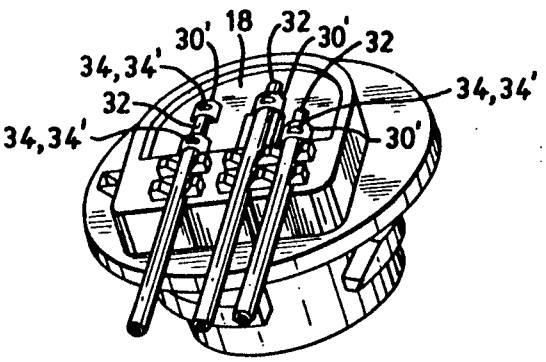
Figure 3G:
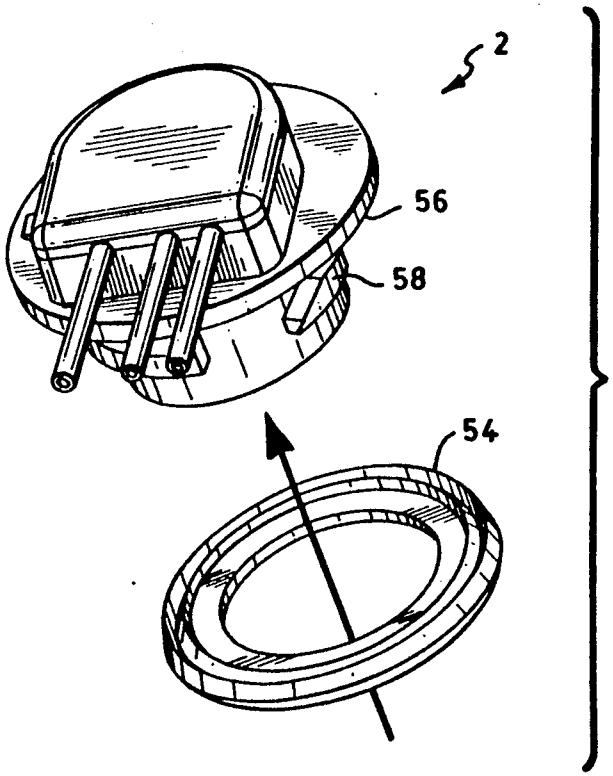
Figure 3F:
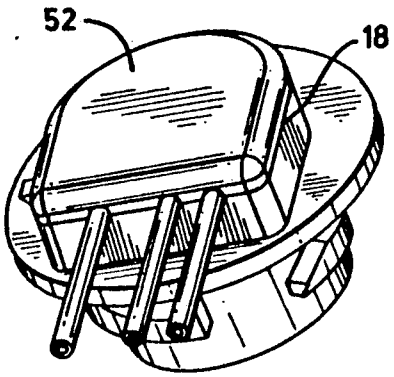

The method of fabricating a lamp socket of the type described herein will be understood by reference to FIGS. 3A to 3G. The housing 2 with slits 20 is provided as depicted in FIG. 3A. Contacts 6A to 6D are then inserted into cavity 4 such that as such contacts are being inserted into the cavity, each leg 30, 30' of each pair of legs is inserted through a respective slit as depicted in FIG. 3B. Subsequently, a portion of each leg 30 is bent so that is substantially parallel to and in engagement with the lower base surface 18 as depicted in FIG. 3C. Then wires 32 are fed into contact with such bent portion of a respective leg 30 as depicted in FIG. 3D. Usually, wires 32 will include insulation 44 which will be stripped in order to provide a segment of the wire 32 for contact with a leg 30. The feeding of wires 32 into position will be facilitated by guide members 36, 38 which serve t guide the wires 32 during the feeding step and to hold the wires in place as described above. When wires 32 are in place, each leg 30 is crimped relative to a respective wire 32 and a respective leg 30 thereby clamping each wire 32 between a leg 30' and a leg 30 to effect electrical connection between respective contacts and respective wires. Preferably, a finite amount of solder paste 34' is applied to aperture 34 of each leg 30' and heat is applied thereto to reflow the solder thereby soldering each wire to at least one leg of the pair of integral legs 30, 30'. The crimping and soldering steps are represented by FIG. 3E. If desired, the sub-assembly thus far produced can be subjected to an electrical test. It will be apparent to those skilled in the art that the process thus far described can be performed sequentially with respect to one wire although in the preferred embodiment the process will be performed sequentially on all three wires. In either event, when all of the wires have been satisfactorily connected to a respective contact 6, a cover is affixed to the lower base surface. In the preferred embodiment, the housing assembly of FIG. 3E will be placed into an injection mold where an integral bottom cover 52 will be over-molded to the lower base surface 18 to effectively restrain and seal the wires 32 and legs 30, 30' between such cover and the lower base surface as depicted in FIG. 3F. In a final step a gasket 54 is applied to a face portion 56 of the housing 2 as depicted in FIG. 3G. Typically, the gasket 54 will be a pre-molded Santoprene gasket which will be stretched to fit over the conventional lamp socket threads 58 such that gasket 54 will bear against a conventional reflector housing when the lamp socket is positioned for use.

The specific embodiment described herein includes four contacts and three wires. However, it will be apparent that other combination of wires and contacts are also possible. For example, a two wire version can be produced by omitting one of the wires having a single contact connection. In such two wire version, when a cover is over-molded to the lower base surface 18, the plastic will fill the wire cavity present as a result of the missing wire.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. An improved lamp socket having a cavity into which a lamp base can be disposed for mechanical connection to said lamp socket and electrical connection to contacts disposed within said cavity, said cavity being formed by at least one wall and having an open upper end and a closed lower end, wherein the improvement comprises:

a base surface forming said closed lower end, said base surface including a plurality of slits extending therethrough, and further including an upper base surface and a lower base surface;

at least two opposing recesses disposed within said at least one wall;

at least two contacts each having a pair of integral legs, each contact of said at least two contact having a portion disposed in a respective recess, each leg of each pair of integral legs extending through a respective slit of said plurality of slits, one leg of each pair of integral legs including a portion which is substantially parallel to and in engagement with said lower base surface and another leg of said pair of integral legs extending from said lower base surface, said another leg of said pair of integral legs being disposed relative to said one leg for clamping a wire between said one leg and said another leg to effect an electrical connection between said contact and said wire.

2. The lamp socket of claim 1 wherein each contact includes a hooked portion at an end opposite said pair of legs, wherein each recess of said at least two opposing recesses includes a recessed base portion, and further wherein each hooked portion extends into a respective recessed base portion.

3. The lamp socket of claim 1 further including a cover which is affixed to said lower base surface.

4. The lamp socket of claim 1 wherein each contact of said at least two contact includes a beam portion which extends towards an opposing side of said cavity.

5. The lamp socket of claim 1 wherein said another leg is longer than said one leg.

6. The lamp socket of claim 1 wherein said another leg includes an aperture extending therethrough.

7. The lamp socket of claim 6 wherein said another leg of said pair of integral legs is disposed relative to said one leg for clamping a wire between said one leg and said another leg to effect an electrical connection between said contact and said wire.

8. The lamp socket of claim 7 wherein a wire is clamped between said one leg and said another leg, and further wherein a solder connection extends from said another leg through said aperture, and to said wire and said one leg.

9. The lamp socket of claim 1 further including means for guiding a wire relative to a respective pair of integral legs.

10. The lamp socket of claim 9 wherein said guiding means further includes means for restraining a wire relative to said respective pair of integral legs.

* * * * *